US007458865B2

(12) United States Patent
Araki

(10) Patent No.: US 7,458,865 B2
(45) Date of Patent: Dec. 2, 2008

(54) POWER DAMPING MECHANISM FOR INPUT SHAFT OF AUXILIARY MACHINE

(75) Inventor: Toshio Araki, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/648,520

(22) Filed: Dec. 29, 2006

(65) Prior Publication Data

US 2008/0160847 A1 Jul. 3, 2008

(51) Int. Cl.
*B63H 21/30* (2006.01)

(52) U.S. Cl. ..... 440/52; 464/72

(58) Field of Classification Search ..... 440/52, 440/83; 464/71, 72

See application file for complete search history.

(56) References Cited

U.S. PATENT DOCUMENTS 1,820,750 A * 8/1931 Lord ..... 464/71
2,362,141 A * 11/1944 Loetterle ..... 464/85
4,793,455 A * 12/1988 Tabuchi et al. ..... 192/84.941
6,508,713 B1 * 1/2003 Kaye ..... 464/71
6,612,813 B2 * 9/2003 Kimura et al. ..... 417/319

* cited by examiner

*Primary Examiner*—Ed Swinehart
(74) *Attorney, Agent, or Firm*—Alleman Hall McCoy Russell & Tuttle LLP

(57) ABSTRACT

A power damping mechanism for an input shaft of an auxiliary machine of an engine that is configured to be driven by the engine via a power transmission mechanism is provided. The power damping mechanism comprises a retainer plate that is fastened to the input shaft of the auxiliary machine and is rotatable with the input shaft, the retainer plate having a plurality of tubular retainer portions arranged to be equally spaced apart from each other in a circumferential direction; a damping member having a damping portion that is fitted to each of the retainer portions and is made of an elastic material, and a fastening portion by which the damping portion is fastened to the power transmission mechanism. The input shaft of the auxiliary machine is coupled to the power transmission mechanism via the damping member and is configured to operate in association with the power transmission mechanism.

8 Claims, 6 Drawing Sheets

POWER DAMPING MECHANISM FOR INPUT SHAFT OF AUXILIARY MACHINE

TECHNICAL FIELD

The present invention relates to a power damping mechanism for an input shaft of an auxiliary machine of an engine. More particularly, the present invention relates to a power damping mechanism for an input shaft of an auxiliary machine of an engine mounted in personal watercraft, for example, a supercharger.

BACKGROUND ART

Some personal watercraft (PWC) is equipped with a supercharger which is one type of an auxiliary machine of an engine mounted therein. The supercharger is typically configured to be driven by a crankshaft of the engine via a belt and pulley mechanism.

Generally, a pulley attached to an input shaft of the supercharger is provided with a driving force disconnecting mechanism such as an electromagnetic clutch. The driving force disconnecting mechanism is aimed at protecting the supercharger from a fluctuation in an engine speed, which tends to increase when a propeller moves away from water surface, for example, the personal watercraft jumps out of the water surface, and to thereafter decrease when the watercraft lands in the water surface.

However, the electromagnetic clutch is required to be made of a magnetic material and thus is susceptible to corrosion because of sea water. Whereas the electromagnetic clutch may be subjected to rust-proof surface treatment, the surface treatment of at least a clutch surface may wear out when the clutch is turned on. For this reason, the electromagnetic clutch is not always suitable for use in the power damping mechanism of the input shaft of the auxiliary machine of the engine mounted in the personal watercraft.

SUMMARY OF THE INVENTION

The present invention addresses the above described conditions, and provides a power damping mechanism for an input shaft of an auxiliary machine of an engine, which is particularly suitable for use with a personal watercraft.

According to a first aspect of the present invention, there is provided a power damping mechanism for an input shaft of an auxiliary machine of an engine that is configured to be driven by the engine via a power transmission mechanism, the power damping mechanism comprising a retainer plate that is fastened to the input shaft of the auxiliary machine and is rotatable with the input shaft of the auxiliary machine, the retainer plate having a plurality of retainer portions arranged to be equally spaced apart from each other in a circumferential direction; a damping member having a damping portion that is fitted to each of the retainer portions and is made of an elastic material, and a fastening portion by which the damping portion is fastened to the power transmission mechanism; wherein the input shaft of the auxiliary machine is coupled to the power transmission mechanism via the damping member and is configured to operate in association with the power transmission mechanism.

In such a construction, the power damping mechanism for the auxiliary machine of the engine which is particularly suitable for the personal watercraft can be provided. Since the power damping mechanism has a simple construction and does not substantially have an operative portion, it will not wear out. In addition, the power damping mechanism may be entirely subjected to rust-proof treatment. For these reasons, the power damping mechanism is suitable for use with the personal watercraft.

The fastening portion of the damping member may include a metal pin.

The auxiliary machine may be a supercharger.

The power transmission mechanism may include a belt and pulley mechanism including a drive pulley coupled cooperatively with the engine and a driven pulley rotatable relative to the input shaft of the supercharger. The fastening portion of the damping member may be fastened to the driven pulley.

The retainer plate may be disposed with a predetermined gap to be in non-contact with the driven pulley of the power transmission mechanism.

The power damping mechanism may further comprise an intermediate plate that is disposed between the retainer plate and the driven pulley of the power transmission mechanism to fasten the fastening portion of the damping member to the driven pulley.

The intermediate plate may have an outer diameter smaller than a diameter of a circle circumscribing a plurality of damping members arranged to be equally spaced apart from each other in the circumferential direction.

According to a second aspect of the present invention, there is provided a personal watercraft comprising an engine; an auxiliary machine of the engine that is configured to be driven by the engine via a power transmission mechanism; and a power damping mechanism for the input shaft of the auxiliary machine, the power damping mechanism including a retainer plate that is fastened to the input shaft for the auxiliary machine and is rotatable with the input shaft, the retainer plate having a plurality of tubular retainer portions arranged to be equally spaced apart from each other in a circumferential direction; a damping member having a damping portion that is fitted to each of the retainer portions and is made of an elastic material, and a fastening portion by which the damping portion is fastened to the power transmission mechanism. The input shaft of the auxiliary machine may be coupled to the power transmission mechanism via the damping member and is configured to operate in association with the power transmission mechanism.

BRIEF DESCRIPTION OF THE DRAWINGS

The disclosure is illustrated by way of example and not by way of limitation in the figures of the accompanying drawings, in which the like reference numerals indicate similar elements and in which.

DETAILED DESCRIPTION OF THE INVENTION

Hereinafter, a power damping mechanism for an auxiliary machine of an engine according to the present invention will be specifically described with reference to the accompanied drawings, by using an example of a personal watercraft equipped with a supercharger. In this embodiment, the application to the supercharger of the engine mounted in the personal watercraft is illustrated. This is merely exemplary and the present invention is applicable to auxiliary machines of any other engines.

Figure 1:
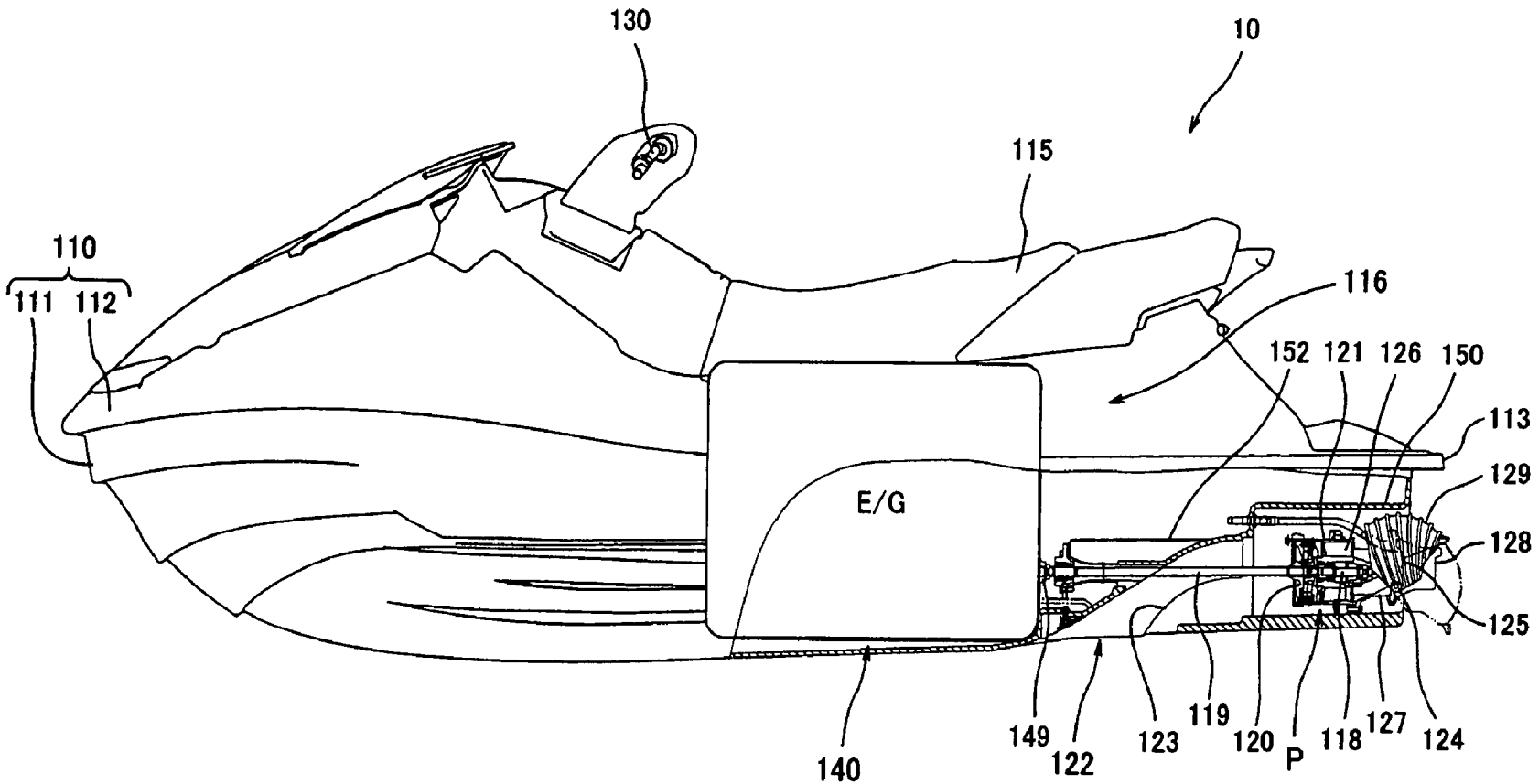
FIG. 1 is a left side view of a personal watercraft according to an embodiment of the present invention, a part of which is cut away to illustrate a propulsion device.
Figure 2:
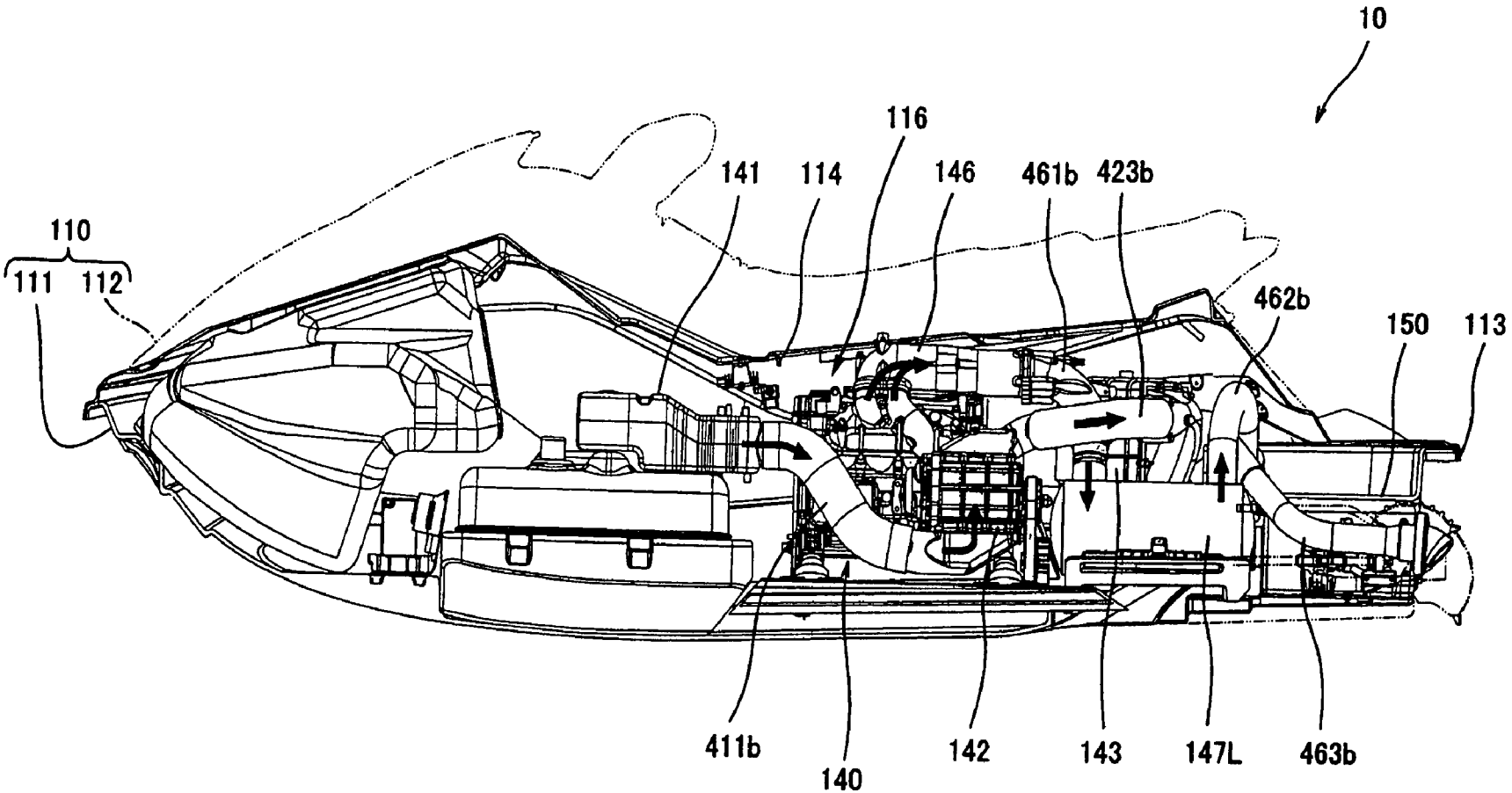
FIG. 2 is a left side view showing a construction of an air-intake and exhaust system of an engine mounted in the personal watercraft of FIG. 1.

As shown in FIGS. 1 and 2, a body 110 of a personal watercraft 10 according to an embodiment of the present invention includes a hull 111 and a deck 112 covering the hull 111 from above. The hull 111 and the deck 112 are joined to each other at a gunnel line 113.

A substantially rectangular opening 114 is formed on an upper surface of the body 110 at a rear region of a center portion of the deck 112 so as to extend in a longitudinal direction of the body 110. The opening 114 is covered from above with a straddle-type seat 115 extending in the longitudinal direction. An engine 140 is mounted in an engine room 116 that is located below the seat 115 and is surrounded by the hull 111 and the deck 112.

As clearly shown in FIG. 1, a crankshaft 149 of the engine 140 extends rearward and a rear end portion of the crankshaft 149 is integrally and rotatably coupled to a pump shaft 118 of a water jet pump P through a propeller shaft 119. An impeller 120 is attached to the pump shaft 118 of the water jet pump P. The impeller 120 is covered with a cylindrical pump casing 121 on the outer periphery thereof.

A water intake 122 is provided on a bottom surface of the hull 111. The water is sucked from the water intake 122 and is fed to the water jet pump P through a water passage 123. The water jet pump P pressurizes and accelerates the water by the impeller 120. The water is ejected through a pump nozzle 127 having a cross-sectional area of flow that is gradually reduced rearward, and then from an outlet port 125 provided at a rear end thereof. As the resulting reaction, the watercraft obtains a propulsion force. The pump casing 121 is provided with fairing vanes 126 to guide water flow behind the impeller 120.

As shown in FIG. 1, a bar-type steering handle 130 is operative in association with a steering nozzle 128 that is mounted behind a pump nozzle 127 so as to be pivotable rightward or leftward around a pivot shaft (not shown). When an operator rotates the handle 130 clockwise or counterclockwise, the steering nozzle 128 is pivoted to orient the personal watercraft in a desired direction.

As shown in FIG. 1, a bowl-shaped reverse deflector 129 is mounted to an upper region of a rear side of the steering nozzle 128 so as to be pivotable downward around a pivot shaft 124 horizontally mounted. The deflector 129 is pivoted downward behind the steering nozzle 128 to direct the water ejected rearward from the steering nozzle 128 forward, so that forward movement of the watercraft switches to rearward movement.

Figure 3:
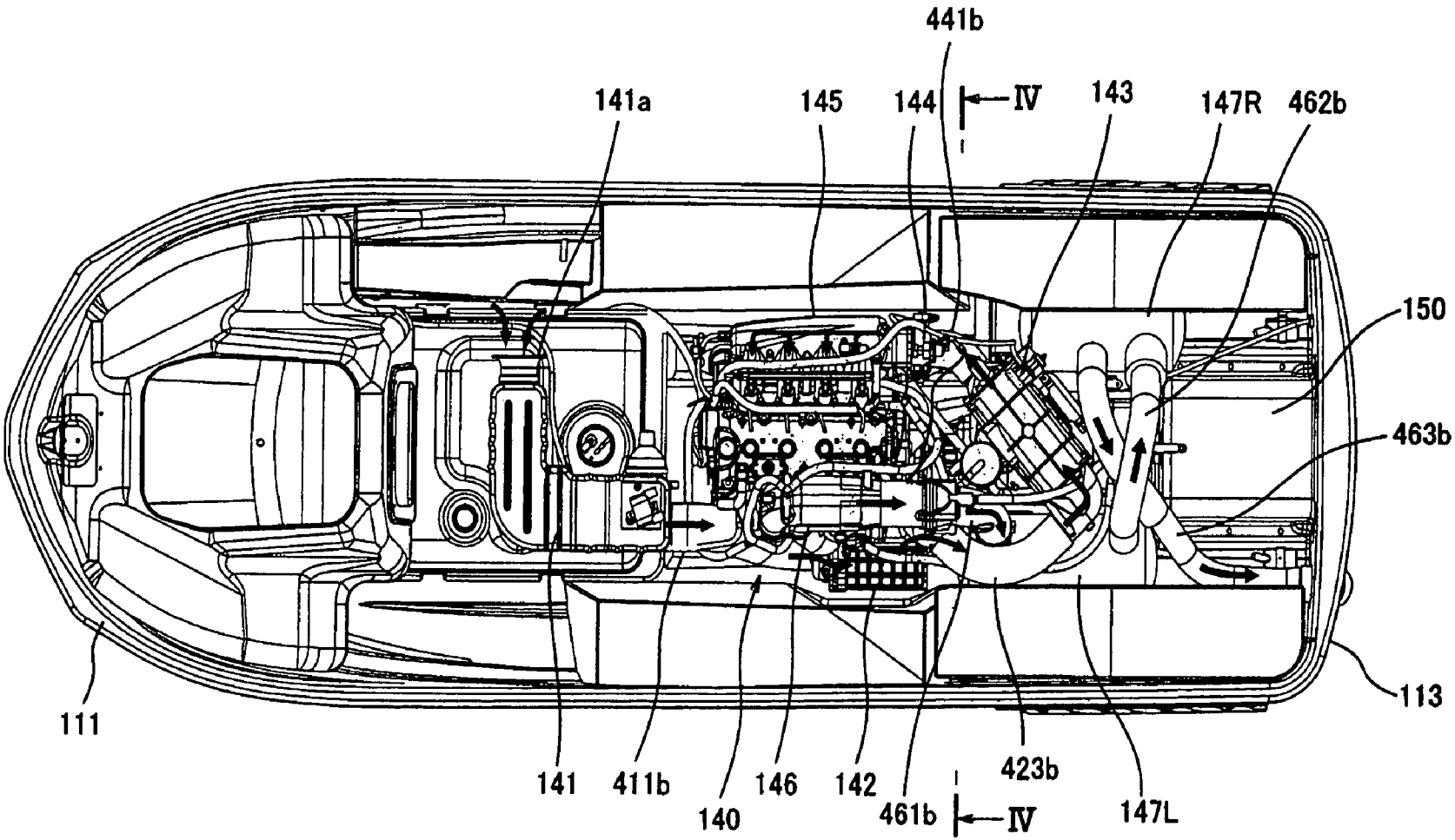
FIG. 3 is a plan view of FIG. 2, with a deck portion omitted.
Figure 4:
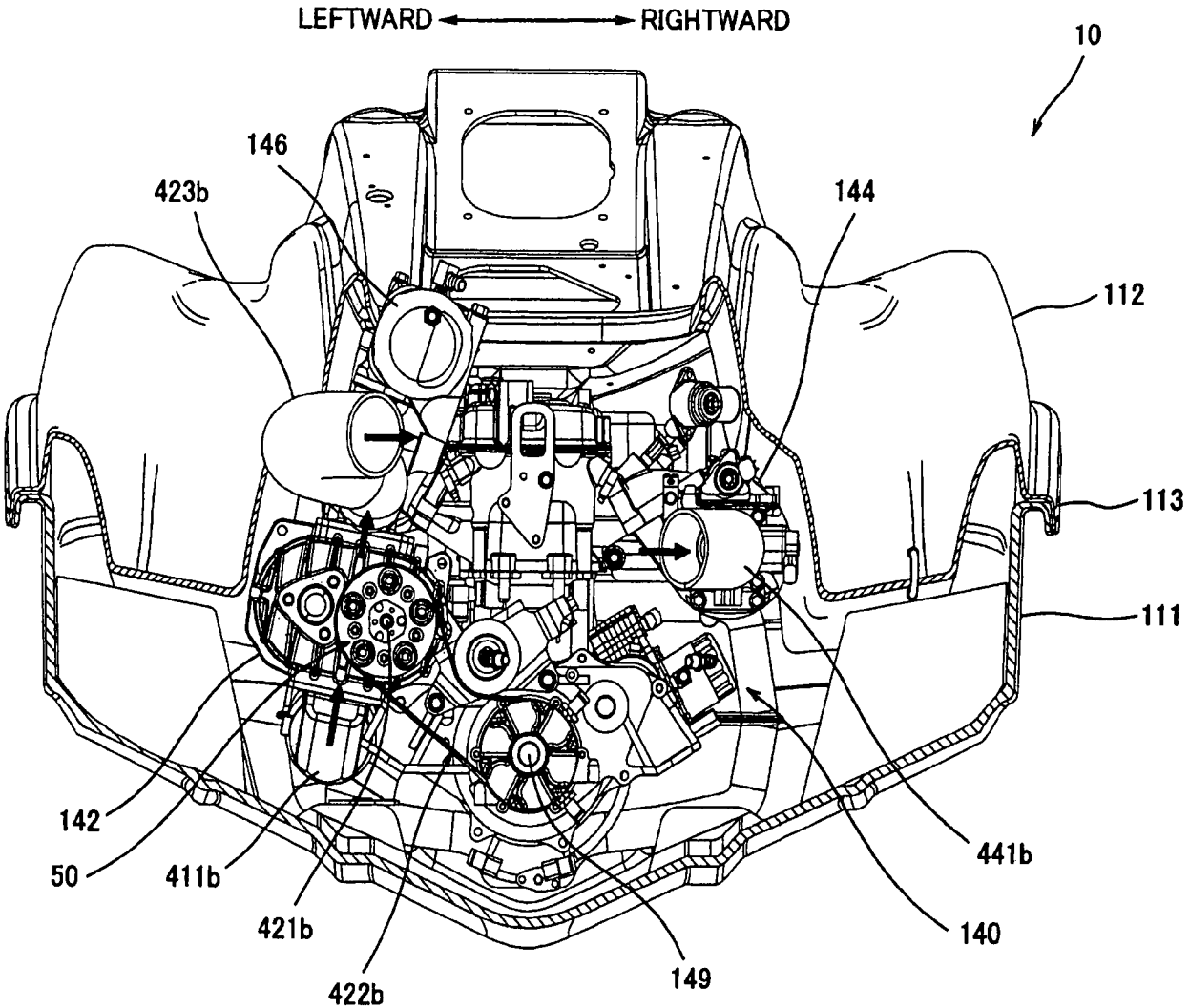
FIG. 4 is a cross-sectional view of the personal watercraft taken along line IV-IV of FIG. 3.

As shown in FIGS. 2 to 4, an air box (also referred to as an air-intake box) 141 is disposed forward of the engine 140. The air box 141 has an L-shaped box form and is provided with an air inlet 141*a* that opens on a right portion thereof. One end of a flexible air-intake pipe 411*b* is coupled to a rear end portion of the air box 141. The air-intake pipe 411*b* extends rearward and its rear end is coupled to an air inlet (see FIGS. 2 and 4) formed on a lower surface of the supercharger 142 which is an auxiliary machine of the engine 140.

The supercharger 142 is mounted at an intermediate stage of a rear portion of a left side surface of the engine 140 in such a manner that a rear half portion thereof protrudes from a rear surface of the engine 140. An exhaust manifold 146 forming an exhaust passage of the engine 140 is mounted above the supercharger 142. The supercharger 142 is configured such that an input shaft 421*b* (as clearly shown in FIG. 6) thereof extending rearward is coupled to a crankshaft 149 via a belt and pulley mechanism 422*b* which is an example of a power transmission mechanism. In this construction, when the crankshaft 149 rotates upon the start of the engine 140, the rotation is transmitted to the input shaft 421*b* of the supercharger 142 via the belt and pulley mechanism 422*b*. According to the rotation of the input shaft 421*b*, the supercharger 142 causes a pump (not shown) internally built to actuate to compress air fed from the air box 141 through the air-intake pipe 411*b*, and feeds the compressed air with relatively high-pressure and high-temperature to an intercooler 143.

An air outlet of the supercharger 142 is formed on an upper surface thereof. One end of an air-intake pipe 423*b* is coupled to the air outlet, and an opposite end of the air-intake pipe 423*b* is coupled to an air inlet (see FIG. 3) formed on a rear end surface of the intercooler 143.

The intercooler 143 is of a thin box-shape in which its thickness direction is oriented horizontally. The intercooler 143 is disposed behind the engine 140 to be tilted from the right to the left in a rearward direction. The intercooler 143 cools the air fed from the supercharger 142 through the air-intake pipe 423*b* and feeds the cooled air to a throttle device (herein, throttle body) 144 through the air-intake pipe 441*b*. An air outlet of the intercooler 143 is formed on an end surface oriented rightward and forward. One end of the air-intake pipe 441*b* is coupled to the air outlet of the intercooler 143 and an opposite end thereof is coupled to an air inlet of the throttle body 144. The throttle device may be other throttle devices such as a carburetor.

The throttle body 144 is disposed adjacent an air inlet of an intake manifold 145 and serves to control an amount of the air fed from the intercooler 143 in association with an operation of a throttle lever (not shown) attached to the steering handle 130 and to feed the air to the intake manifold 145 connected to the throttle body 144.

The intake manifold 145 extends over an upper portion of a right side surface of the engine 140 substantially entirely in the longitudinal direction. The intake manifold 145 is configured to distribute the air with the controlled amount that is fed from the throttle body 144 provided at a rear part thereof and to feed the air to a combustion chamber (not shown) of each cylinder which is formed on a cylinder block through an intake port formed on a cylinder head.

After combustion, an exhaust gas gathers to an exhaust manifold 146 through an exhaust port (not shown) formed on the cylinder head. The exhaust manifold 146 extends over an upper portion of a left side surface of the engine 140 substantially entirely in the longitudinal direction. One end of a flexible exhaust pipe 461*b* is coupled to a rear end portion of the exhaust manifold 146. An opposite end of the exhaust pipe 461*b* extends rearward and then is bent downward to be coupled to a first water muffler 147L mounted on a left side behind the engine 140, i.e., left side of a bearing case 152 (left side (see FIG. 1)) disposed immediately forward of a pump room 150. The first water muffler 147L is coupled through a flexible exhaust pipe 462*b* to a second water muffler 147R disposed on the right side (right side of the bearing case 152) behind the engine 140.

Thereby, the exhaust gas gathering to the exhaust manifold 146 is delivered to the first water muffler 147L through the exhaust pipe 461*b*, and then to the second water muffler 147R through the exhaust pipe 462*b*. Finally, the exhaust gas is discharged outside the watercraft through an exhaust pipe 463*b* extending from the second water muffler 147R.

Figure 5:
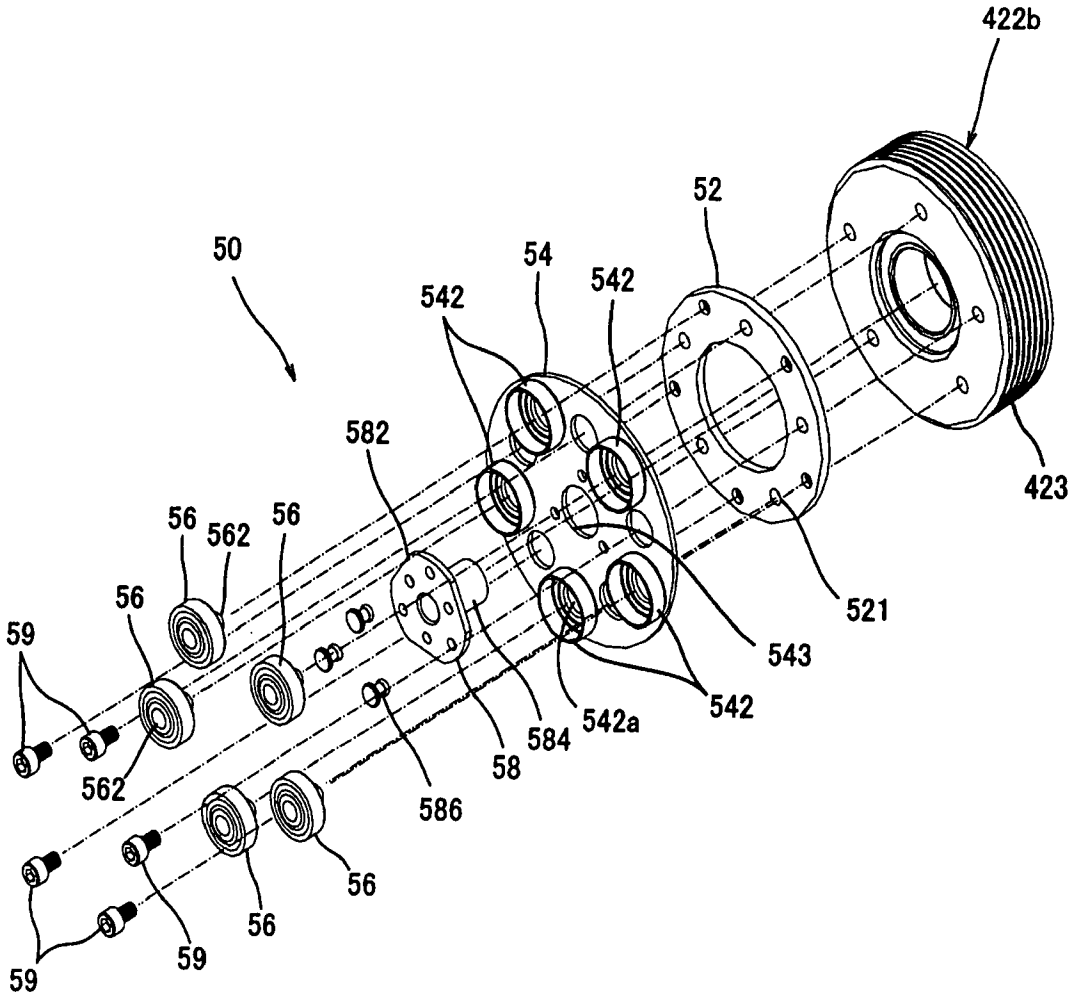
FIG. 5 is an exploded perspective view of a power damping mechanism for an input shaft of a supercharger of FIG. 4.
Figure 6:
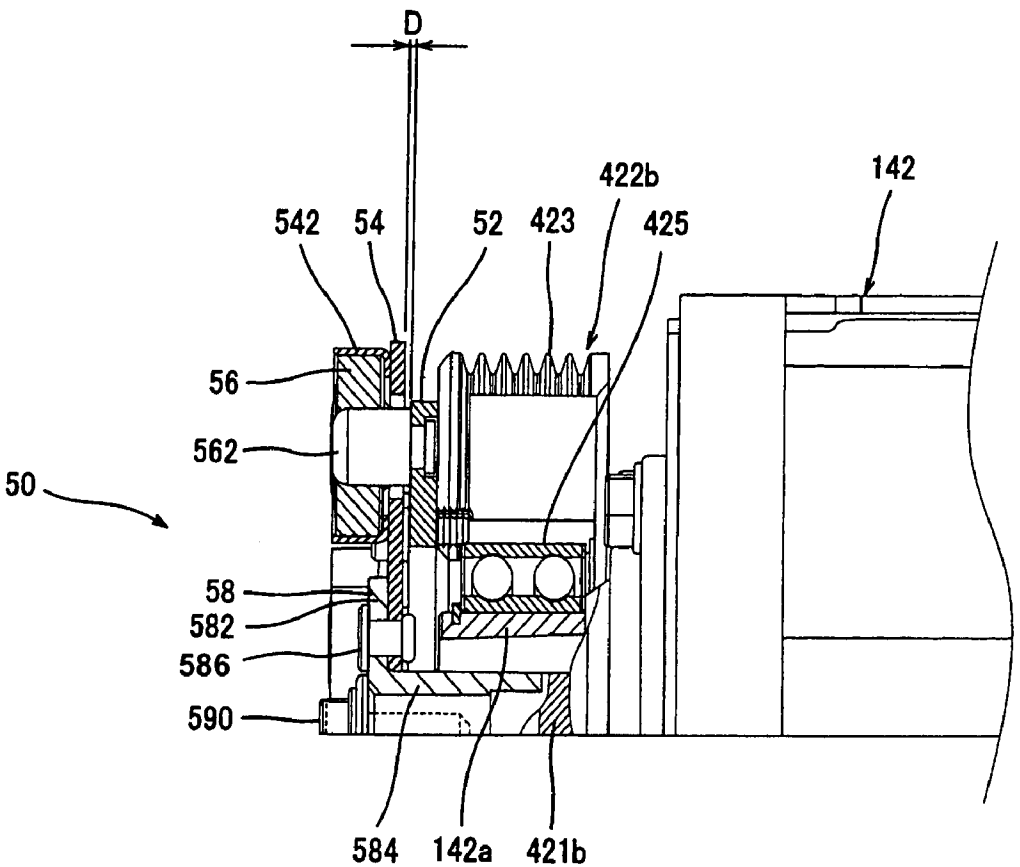
FIG. 6 is a longitudinal sectional view of the power damping mechanism for the input shaft of FIG. 5.

Subsequently, a power damping mechanism 50 of the input shaft 421*b* of the supercharger 142 will be described with reference to FIGS. 4 to 6. The power damping mechanism 50 of this embodiment is mounted in a power transmission path extending between the input shaft 421*b* of the supercharger 142 and a driven pulley 423 that is included in the belt and pulley mechanism 422*b* which is the power transmission mechanism for the input shaft 421*b* and is configured to be driven by a drive pulley (not shown) of the engine 140.

The driven pulley 423 is mounted via a bearing 425 (see FIG. 6) to an outer periphery of a boss portion 142*a* that is mounted to be integral with the supercharger 142 and to extend from an end portion of the supercharger (to be specific, a cover of the supercharger) 142 over an outer periphery of the input shaft 421*b* in parallel with (leftward in FIG. 6) the input shaft 421*b* so that the driven pulley 423 is rotatable freely relative to the input shaft 421*b*. In this construction, the power is not directly transmitted from the belt and pulley mechanism 422*b* to the input shaft 421*b* through the driven pulley 423.

An annular intermediate plate 52 is coaxially fastened to an outer surface in a rotational axis direction of the drive pulley 423 by five bolts 59. Further, a retainer plate (circular plate) 54 having a diameter larger than that of the annular intermediate plate 52 is disposed coaxially with a predetermined gap D (FIG. 6) to be in non-contact with the intermediate plate 52. The retainer plate 54 is provided with a plurality of (five in this embodiment) tubular retainer portions 542 which are equally spaced apart from each other in the circumferential direction.

A short and annular damper member 56 which has a protruding portion near a center hole thereof is fitted to each retainer portion 542. The damper member 56 is made of an elastic material such as rubber or plastic. A metal pin 562 is typically integrally fitted to the center hole by, for example, seizing. The pin 562 extends to an inner side of the intermediate plate 52 through an opening 542*a* formed on the retainer portion 542 and is disposed to be in non-contact with the retainer portion 542. The pin 562 is fastened to the intermediate plate 52 by caulking. That is, the damper member 56 fitted to the retainer portion 542 of the retainer plate 54 is rigidly fastened to the side surface of the pulley 423 with the intermediate plate 52 interposed therebetween.

An end cap 58 is fitted to an opening 543 formed at a center region of the retainer plate 54. The end cap 58 has a flange portion 582 via which the end cap 58 is fastened to the retainer plate 54 by three rivets 586. The end cap 58 has a cylindrical portion 584 that protrudes from the flange portion 582 and has a spline on an inner side thereof. The cylindrical portion 584 is fitted to a spline formed on an outer periphery of an end portion of the input shaft 421 b of the supercharger 142 and is fastened to the input shaft 421 b by a bolt 590 to be axially unmovable.

Subsequently, a procedure for assembling the power damping mechanism 50 will be described. First, the damper members 56 with the pins 562 are inserted into the retainer portions 542, and then the pins 562 of the damper members 56 are inserted into penetrating holes 521 of the intermediate plate 52. The pins 562 are fastened to the intermediate plate 52 by caulking. Then, the end cap 58 is fastened to the retainer plate 54 by the rivets 586. Thus, the damper members 56, the retainer plate 54, the intermediate plate 52, and the end cap 58 are assembled into a product, i.e., the power damping mechanism 50. Then, an inner peripheral spline of the cylindrical portion 584 of the end cap 58 of the assembled product of the power damping mechanism 50, which is a unitary component, is fitted to an outer peripheral spline of the input shaft 421*b* of the supercharger 142, and an end portion of the end cap 58 is unmovably fastened to the input shaft 421*b* by the bolt 590. Then, the intermediate plate 52 is attached to the side surface of the driven pulley 423 by bolts 59. Since the power damping mechanism 50 is assembled as the unitary component in advance, it can be very easily mounted or dismounted between the power transmission mechanism such as the belt and pulley mechanism and the input shaft of the auxiliary machine.

The power damping mechanism 50 constructed above operates as follows. The rotation of the crankshaft 149 of the engine 140 is transmitted to the driven pulley 423 on the supercharger 142 side through the belt and pulley mechanism 422*b*. The rotation of the driven pulley 423 is applied to the pins 562 of the damper members 56 through the intermediate plate 52 fastened to the driven pulley 423. The circumferential force applied to the pins 562 of the damper members 56 is applied to the retainer portions 542 elastically via the damper members 56, causing the retainer plate 54 to rotate.

The rotation of the retainer plate 54 is transmitted to the end cap 582 fastened to the retainer plate 54. Then, the rotation of the end cap 58 is transmitted to the input shaft 421*b* fastened to the end cap 58, driving the supercharger 142.

In the power damping mechanism 50 of this embodiment, since the rotation of the crankshaft 149 of the engine 140 is transmitted to the input shaft 421*b* of the supercharger 142 elastically via the damper members 56, an impact generated during increase and decrease in an engine speed can be reduced.

Whereas the intermediate plate 52 is provided in this embodiment, it may alternatively be omitted by, for example, directly fastening the pins 562 of the damper members 56 to the driven pulley 423. Since the gap D is formed between the intermediate plate 52 and the retainer plate 54 which are rotatable relative to each other, they are not interfered with each other and hence their operations are not impeded. Furthermore, it is desirable to set the outer diameter of the intermediate plate 52 smaller than a diameter of a circle circumscribing the damper members 56 which are a plurality of damping members which are arranged to be equally spaced apart from each other in the circumferential direction, because the retainer plate 54 does not substantially interfere with the intermediate plate 52 even if the retainer plate 54 is twisted or distorted by a force from the engine 140 that is applied to the damper members 56 through the pins 562. Moreover, in this embodiment, the belt and pulley mechanism is described as an example of the power transmission mechanism 422*b*, a chain and sprocket mechanism including a chain and sprockets may alternatively be employed, as a matter of course.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions and elements, and/or properties may be claimed through amendment of the present claims or through presentation of new claims in this or a related application. Such claims and whether broader, narrower, equal, and/or different in scope to the original claims, also are regarded as included within the subject matter of the present disclosure.

The invention claimed is:

1. A power damping mechanism for an input shaft of an auxiliary machine of an engine that is configured to be driven by the engine via a power transmission mechanism, the power damping mechanism comprising:

a retainer plate that is fastened to the input shaft of the auxiliary machine and is rotatable with the input shaft, the retainer plate having a plurality of tubular retainer portions arranged to be equally spaced apart from each other in a circumferential direction;

a damping member having a damping portion that is fitted to each of the retainer portions and is made of an elastic material, and a fastening portion by which the damping portion is fastened to the power transmission mechanism;

an intermediate plate that is disposed between the retainer plate and the power transmission mechanism to fasten the fastening portion of the damping member to the power transmission mechanism; and an end cap configured to fasten the retainer plate to the input shaft;

wherein the input shaft of the auxiliary machine is coupled to the power transmission mechanism via the damping member and is configured to operate in association with the power transmission mechanism; and wherein the end cap, the retainer plate, the damping member, and the intermediate plate are removably mountable as a unitary component to the power transmission mechanism and the input shaft.

2. The power damping mechanism according to claim 1, wherein the fastening portion of the damping member includes a metal pin.

3. The power damping mechanism according to claim 1, wherein the auxiliary machine is a supercharger.

4. The power damping mechanism according to claim 3, wherein the power transmission mechanism includes:

a belt and pulley mechanism including a drive pulley coupled cooperatively with the engine and a driven pulley rotatable relative to the input shaft of the supercharger, and the fastening portion of the damping member is fastened to the driven pulley.

5. The power damping mechanism according to claim 4, wherein the retainer plate is disposed with a predetermined gap to be in non-contact with the driven pulley of the power transmission mechanism.

6. The power damping mechanism according to claim 1, wherein the intermediate plate has an outer diameter smaller than a diameter of a circle circumscribing a plurality of damping members arranged to be equally spaced apart from each other in the circumferential direction.

7. A personal watercraft comprising:

an engine;

an auxiliary machine of the engine that is configured to be driven by the engine via a power transmission mechanism; and a power damping mechanism for the input shaft of the auxiliary machine, the power damping mechanism including:

a retainer plate that is fastened to the input shaft of the auxiliary machine and is rotatable with the input shaft, the retainer plate having a plurality of tubular retainer portions arranged to be equally spaced apart from each other in a circumferential direction; and a damping member having a damping portion that is fitted to each of the retainer portions and is made of an elastic material, and a fastening portion by which the damping portion is fastened to the power transmission mechanism;

an intermediate plate that is disposed between the retainer plate and the power transmission mechanism to fasten the fastening portion of the damping member to the power transmission mechanism; and an end cap configured to fasten the retainer plate to the input shaft;

wherein the input shaft of the auxiliary machine is coupled to the power transmission mechanism via the damping member and is configured to operate in association with the power transmission mechanism; and wherein the end cap, the retainer plate, the damping member, and the intermediate plate are removably mountable as a unitary component to the power transmission mechanism and the input shaft.

8. A power damping mechanism for an input shaft of an auxiliary machine of an engine that is configured to be driven by the engine via a power transmission mechanism, the power damping mechanism comprising:

a retainer plate that is fastened to the input shaft of the auxiliary machine and is rotatable with the input shaft, the retainer plate having a plurality of tubular retainer portions arranged to be equally spaced apart from each other in a circumferential direction;

a damping member fitted to each of the retainer portions, the damping member having a damping portion made of elastic material and a fastening portion by which the damping portion is fastened to the power transmission mechanism;

wherein the input shaft of the auxiliary machine is coupled to the power transmission mechanism via the damping member and is configured to operate in association with the power transmission mechanism;

wherein the power damping mechanism further comprises an intermediate plate that is disposed between the retainer plate and the power transmission mechanism to fasten the fastening portion of the damping member to the power transmission mechanism; and wherein the intermediate plate has an outer diameter smaller than a diameter of a circle circumscribing a plurality of damping members arranged to be equally spaced apart from each other in the circumferential direction.

* * * * *